United States Patent [19]

Ross et al.

[11] Patent Number: 4,886,113

[45] Date of Patent: Dec. 12, 1989

[54] POSITIVE INDICATION SHEAR RING

[75] Inventors: Colby M. Ross, Carollton; Frank Giusti, Jr., Lewisville; James D. Hendrickson, Carrollton, all of Tex.

[73] Assignee: Otis Engineering Corporation, Carrollton, Tex.

[21] Appl. No.: 166,898

[22] Filed: Mar. 11, 1988

[51] Int. Cl.[4] ..... E21B 33/10

[52] U.S. Cl. ..... 166/51; 166/242; 166/344; 166/217; 285/3; 285/321

[58] Field of Search ..... 166/51, 206, 217, 214, 166/215, 115, 116, 125, 182, 242, 344; 24/614, 622, 626; 285/3, 4, 305, 321; 403/326, 371; 411/352, 353

[56] References Cited

U.S. PATENT DOCUMENTS

| | | | |
|---|---|---|---|
| 2,998,077 | 8/1961 | Keithahn | 166/226 |
| 3,412,774 | 11/1968 | Schuster | 411/353 |
| 3,917,425 | 11/1975 | Allaben, Jr. | 403/371 |
| 4,494,609 | 1/1985 | Schwendemann | 166/336 |
| 4,509,594 | 4/1985 | Milberger et al. | 166/214 X |
| 4,541,484 | 9/1985 | Salerni et al. | 166/278 |
| 4,611,829 | 9/1986 | Hughes | 285/321 X |
| 4,722,392 | 2/1988 | Proctor et al. | 166/217 |

*Primary Examiner*—William P. Neuder

*Attorney, Agent, or Firm*—Dennis T. Griggs

[57] ABSTRACT

A positive position indicating tool includes a snap ring mounted on a mandrel. The snap ring is blocked on the mandrel by a shear sleeve and provides a positive stop to upward retraction of a work string. The snap ring is shearably released when it is desired to retract and/or retrieve the work string. The snap ring is supported on the mandrel by a shear sleeve which is locked onto the mandrel by shear pins. An annular recess is formed in the sidewall of the mandrel between the shear pins and the snap ring. As the tension loading on the work string increases above the combined shear strength of the shear pins, the shear sleeve and positive indication snap ring are displaced downwardly along the mandrel, and the snap ring moves into the annular recess and contracts radially out of obstructing engagement. The snap ring incorporates alternating slots which permit it to expand and recover without permanent deformation. The slots are angularly displaced from a large angle at the back of the ring to progressively smaller displacement angles toward the open end portions of the ring. The slots are more widely separated and are shallower in the high stress regions of the snap ring, and are more closely located and are deeper in the low stress regions of the ring.

15 Claims, 4 Drawing Sheets

POSITIVE INDICATION SHEAR RING

FIELD OF THE INVENTION

This invention relates generally to retrievable tools and equipment for servicing downhole wells, and in particular to apparatus for providing positive restriction to longitudinal movement of a work string which permits a downhole service tool attached to the work string to be positioned at a pre-selected location relative to downhole equipment.

BACKGROUND OF THE INVENTION

In the course of treating and preparing subterranean wells for production, a well packer and one or more screens along with a service tool are run into the well on a work string, with the packer being set against a casing bore. In a gravel pack service operation, a service seal unit is mounted on the work string and is reciprocated relative to certain flow ports and sealing points within the packer bore to route service fluid through various passages. The service seal unit carries vertical and lateral circulation passages which, when aligned with ports formed in the packer, permit service fluid such as acids, polymers, cements and gravel laden liquids to be injected into the formation through the bore of the work string and into the outer annulus between the sand screen and the perforated well casing.

At the well site, the casing is perforated across the production zone to allow production fluids to enter the well bore. In some wells, lower and upper sand screens are installed in the flow path opposite the perforations in the casing. Packers are set above and below the sand screens to seal off the annular region where production fluids are permitted to flow into the tubing. The annulus around the screens is packed with relatively coarse sand or gravel to reduce the amount of fine formation sand reaching the screens. The gravel is pumped down the work string in a slurry of water or gel and is spotted directly under the packer or above each sand screen. Typically, a lower telltale screen is joined to a primary sand screen by a nipple having a polished bore. The polished bore of the nipple is sealed against a wash pipe which is connected to the lower end of the service seal unit.

To assist in spotting the gravel around the lower telltale screen and around the upper primary screen, the service seal unit must be retracted from its run-in position to a first lower circulating position in which the tail pipe is sealed within the polished bore of the screen connection nipple. In this position, gravel is pumped through the work string and through the bore of the service seal unit into the annulus between the screen and the casing. The gravel pack is deposited as gravel accumulates in the annulus around the lower telltale screen, with the gel or water carrying liquid being circulated upwardly through the wash pipe and through the annulus between the packer and the service seal unit into the annulus between the well casing and the work string, where it is returned to the surface.

After the gravel pack has been deposited around the lower telltale screen, the service seal unit is retracted further within the polished bore of the packer to an upper circulating position in which the seal between the wash pipe and the polished bore of the screen connection nipple is opened. In this position, the slurry is pumped down the work string through the flow ports of the service seal unit into the annulus between the tail pipe and the well casing. The coarse gravel accumulates above the lower gravel pack in the annulus between the upper screen and the perforated well casing. The water or gel is then circulated to the surface through the wash pipe and through the annulus above the packer between the work string and the well casing.

The success of the foregoing gravel pack operation is dependent upon the ability to retract the service seal unit an appropriate distance to position its lateral flow passages properly, and also to insure that the seal between the wash pipe and the polished bore of the screen connection nipple is established for the lower circulating mode, and is open for the upper circulating mode.

DESCRIPTION OF THE PRIOR ART

During an initial run-in operation, a well packer, lower telltale screen, production screen and service tool are run into the well on a work string, and the packer is set against the casing bore. In some cases, the service seal unit is attached to the packer by shear pins, with the packer, service seal unit and wash pipe being run in together. After the packer has been set, the service tool is released from the packer by pulling the work string upwardly to cause shearing of separation shear pins. The wash pipe is initially received in sealing engagement with the polished bore of the screen connection nipple. At this stage, a particular gravel pack operation can be initiated by positioning flow ports of the service seal tool in communication with certain flow passages in the packer to establish a lower circulating position, an upper circulating position, or a reverse out position.

Present methods for determining the relative position of a suspended service tool involve measurements of surface displacements of the work string and monitoring tension and hydraulic pressure levels. Top side measurements of work string displacement may be unreliable in deep or deviated wells because of the inherent "stretch" in the work string and because of frictional binding between the work string and well casing. Hydraulic pressure measurements may be ambiguous without specific knowledge of downhole equipment settings and/or relative positions. Work string tension loading levels monitored at the surface have been used in combination with collet latch assemblies for indicating latching engagement of the collet against a locator ring having a known location, as disclosed in U.S. Pat. No. 4,722,392.

In U.S. Pat. No. 4,722,392 a production sub suspended from a packer carries one or more internal locator rings. A collet latch assembly including fixed and floating collet members is connected to a downhole service tool and is inserted into releasable coupling engagement with the locator rings. Resilient finger portions of the fixed collet are alternately supported and unsupported by the floating collet to establish positive engagement with a locator ring. This arrangement provides positive restriction to longitudinal movement of the work string, thereby allowing the downhole service tool attached to the work string to be selectively positioned at predetermined operating locations relative to the packer.

There is a continuing interest in providing improved positive position indicating tools for accommodating well service procedures such as a gravel pack operation.

SUMMARY OF THE INVENTION

The positive position indicating tool of the present invention is a shear ring assembly which is mounted on a mandrel between the wash pipe and the service seal unit. A positive indication snap ring is blocked on the mandrel by a shear sleeve and provides a positive stop to retraction of the service seal unit and the work string. The snap ring can be shearably released when it is desired to retrieve the work string and service seal unit. The mandrel joins the lower end of the service seal unit with the snap ring being positioned for obstructing engagement against the beveled face of a ported flow sub which is attached to the packer. The fixed axial spacing of the snap ring relative to the flow ports of the service seal unit is pre-established to provide communication between flow ports and passages of the service seal unit with certain flow ports and passages in the packer when the positive indication snap ring is drawn into engagement with the beveled face of the ported flow sub.

In the preferred embodiment, the engaged position of the positive indication snap ring with the ported flow sub corresponds with an upper circulating gravel pack operation. As the service seal unit is extended downwardly and fully landed within the packer, the positive snap ring is disengaged from the flow sub and the wash pipe is inserted into sealed engagement with the polished bore of a screen connection nipple, which corresponds with a lower circulating operating mode.

The positive indication shear ring is supported on the mandrel by the annular face of a shear sleeve which is pinned to the mandrel. The individual shear rating of the pins and the number of pins determines the tension level required to shear the pins and displace the shear sleeve.

An external, annular recess is formed in the sidewall of the mandrel between the shear pins and the snap ring. The snap ring has a radially projecting, annular shoulder which is engaged on its underside by an annular face of the shear sleeve. As the tension loading on the work string increases above the combined shear strength of the shear pins, the shear sleeve and positive indication snap ring are displaced downwardly along the mandrel, and the snap ring moves into the annular recess and contracts to permit the snap ring to pass through the polished bore of the ported flow sub. A portion of the shear sleeve overlaps the retracted snap ring to retain the snap ring within the annular recess.

The positive indication snap ring is initially expanded about the mandrel sidewall for performing its stop function. The snap ring incorporates alternating slots which permit it to expand and recover without permanent deformation. In the preferred embodiment, the slots are angularly displaced with respect to the center line of the snap ring from a large angle at the back of the ring to progressively smaller angles toward the front of the ring. Additionally, the depth of slots near the back portion of the snap ring is less than the depth of slots in the front of the snap ring, with shallow slots being formed in the back region of the snap ring which is subject to higher stress, and with the deeper slots being formed in the front portions of the ring which are subjected to relatively lower stress.

That is, the slots are more widely separated and are shallower in the high stress regions of the snap ring, and are more closely located and are deeper in the low stress regions of the ring. As a result, the stress forces which arise as the ring is expanded to fit about the external surface of the mandrel are more uniformly distributed through the ring. This permits the thickness of the body of the ring to be increased without compromising flexibility. With increased ring thickness, the surface area of contact is increased which means that the thicker ring can sustain a relatively higher shear load. A higher shear load rating is desirable so that the service operations can be performed through a higher work string tension range without overloading the shear ring.

Other features and advantages of the present invention will be appreciated by those skilled in the art upon reading the detailed description which follows with reference to the attached drawings.

DETAILED DESCRIPTION OF THE PREFERRED EMBODIMENT

Figure 1:
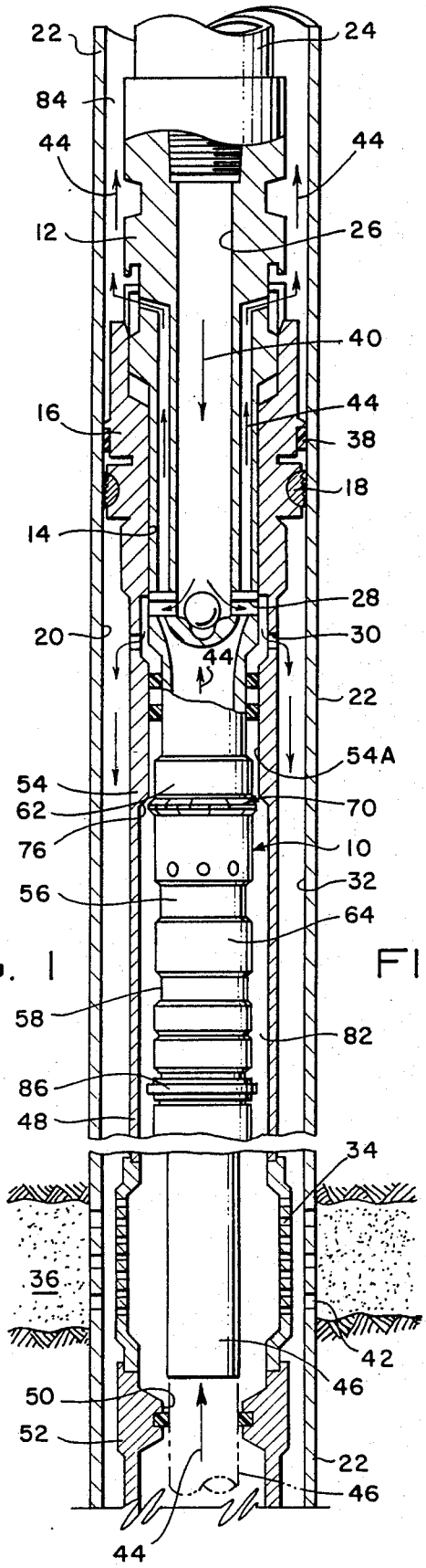
FIG. 1 is a simplified view, partially in section and elevation, showing a typical well installation in which the positive indication snap ring is received in stop engagement with a ported flow sub in an upper circulating mode of operation.

In the description which follows, like parts are marked throughout the specification and drawings with the same reference numerals, respectively. The drawings are not necessarily to scale and the proportions of certain parts have been exaggerated to better illustrate details of the present invention.

Referring now to FIG. 1, operation of a shear ring assembly 10 will be explained with reference to a typical gravel pack service operation in which a service seal tool 12 is landed within the polished bore 14 of a packer 16. The packer 16 has slips 18 which are moved into engagement with the casing bore 20 of well casing 22 by a hydraulically actuated setting portion of the service tool 12. The service tool 12 is sealed against the bore of the packer 16 for delivering a gravel slurry pumped through a work string 24 and bore 26 of the service tool through lateral flow passages 28 which intersect the sidewall of the service tool 12, and which communicate with lateral flow passages 30 which intersect the sidewall of the packer 16. The annulus 32 between the casing 22 and sand screen 34 is sealed above and below a producing formation 36 by expanded annular seal elements 38 carried on packer 16 and expanded annular seal elements carried on a sump packer (not illustrated).

During a gravel pack operation, slurry 40 is pumped through the work string 24 and the bore 26 of the service tool 12 through the lateral flow passages 28, 30 into the annulus 32. The slurry is forced through perforations 42 formed in the sidewall of the well casing 22 to the surrounding formation 36. Coarse gravel is spotted in the annulus around the sand screen 34 and the water or gel carrier 44 is recovered and pumped to the surface through a wash pipe 46 which is hung off of the service seal unit 12. The wash pipe 46 is received within a length of production tubing 48 which supports the production screen 34. The wash pipe 46 is extendable into sealing engagement with the polished bore 50 of screen connection nipple 52 to accommodate a lower circulating gravel pack operation.

During the initial run-in operation, the packer 16, lower telltale screen, production screen 34 and the service tool 12 are run into the well on the work string 24, and the packer 16 is set against the casing bore 32. The service seal unit 12 is attached to the packer 16 by shear pins, with the packer, service seal unit, wash pipe and screens being run in together. After the packer 16 has been engaged and set, the service tool 12 is released from the packer by moving the work string upwardly to cause shearing of the separation shear pins. Upon release and separation of the service seal unit 12 from the packer, the wash pipe 46 is received in sealing engagement within the polished bore 50 of the screen connection nipple 52, as indicated in phantom. That is, initially, the tail pipe 46 and service seal unit 12 are known to be positioned at the appropriate downhole locations to accommodate a lower circulating gravel pack operation.

Figure 2:
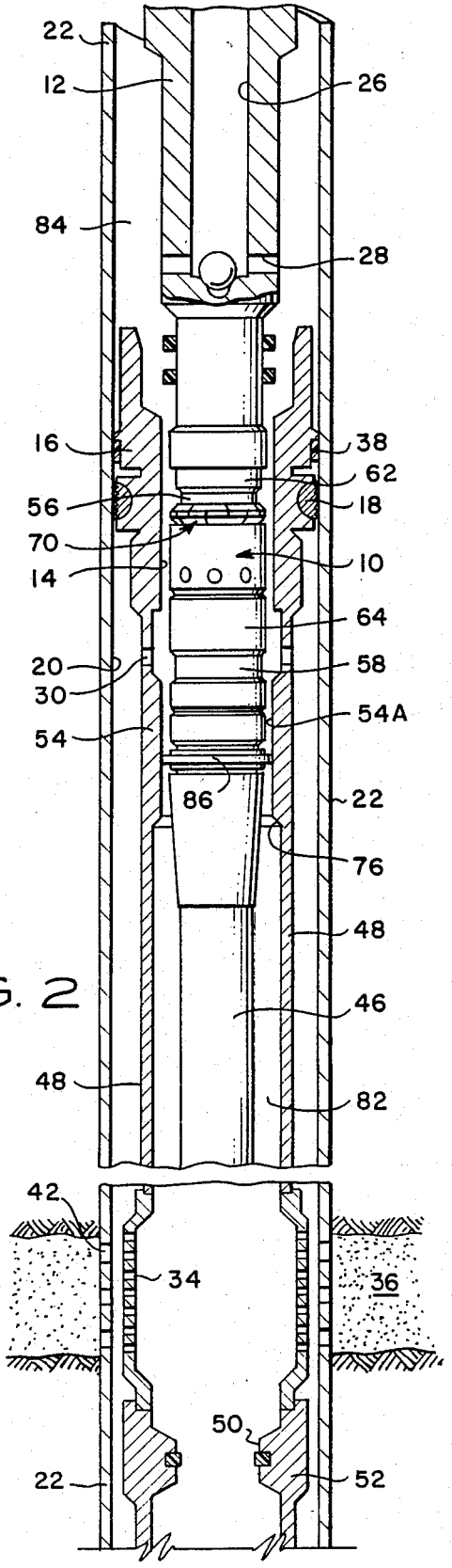
FIG. 2 is simplified view similar to FIG. 1 in which the shear sleeve support for the positive indication snap ring has been overloaded and the snap ring has retracted clear of the honed bore of the ported flow sub to permit the service seal unit to be retracted to its reverse out operating position.

To initiate a different gravel pack operation, for example an upper circulating gravel pack, it is necessary that the flow ports of the service seal tool 12 be aligned for communication with flow ports and passages in a ported flow sub 54 which is extended from the packer 16, and it is also necessary to retract the wash pipe 46 out of engagement with the polished bore 50 of the screen connection nipple 52, as shown in FIG. 1. This particular positioning of the service seal unit 12 relative to the packer 16 and the wash pipe 46 relative to the polished bore of the screen connection nipple can only be obtained through a very narrow range of longitudinal movement. Accordingly, a releasable stop is required to halt retraction of the work string 24 when the service seal unit 12 and wash pipe 46 are correctly positioned for the next gravel pack operation, and an indicator is needed to provide a positive indication that the mechanical stop has been overcome as the work string and service seal unit are retracted further to accommodate yet another gravel pack operation, for example a reverse out procedure as shown in FIG. 2.

Referring now to FIG. 1, FIG. 3, FIG. 4 and FIG. 5, the mechanical stop and positive position indicating functions are provided by the shear ring assembly 10 which is attached between the service seal unit 12 and the wash pipe 46. The shear ring assembly 10 includes a tubular mandrel 56 and a tubular adaptor sub 58. The mandrel 56 has a bore 60 and a box connector 62 having threads 62A for attachment to the lower end of the service seal unit 12. The adaptor sub 58 is joined to the mandrel 56 by a threaded box connector 64 having threads 64A. The box connector 62 and the box connector 64 each have radially stepped shoulders 66, 68, respectively, which stop movement of a snap ring 70 and shear sleeve 72.

Figure 5:
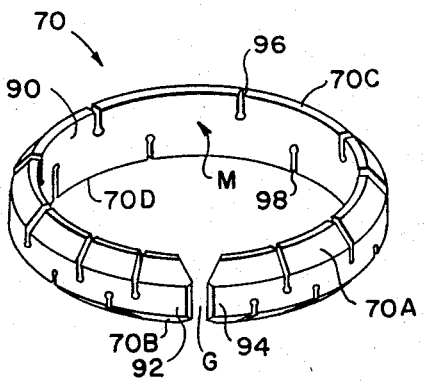
FIG. 5 is a perspective view of the positive indication snap ring shown in FIGS. 3 and 4.

The positive indication snap ring 70 is fitted about the external cylindrical surface 56A of the mandrel 56. According to one feature of this embodiment, the snap ring 70 engages the external cylindrical surface 56A in a compression union by virtue of its internal spring action which tends to restore it from its expanded, stressed condition to its retracted, relaxed condition as shown in FIG. 5. The positive indication snap ring 70 is mechanically blocked in its expanded position of engagement about the mandrel surface 56A by a tubular shear sleeve 72. The tubular shear sleeve 72 has a cylindrical bore 72A in which the mandrel 56 is received. The shear sleeve 72 is dimensioned for sliding extension and retraction along the cylindrical mandrel surface 56A.

The shear sleeve 72 is mechanically locked onto the mandrel 56 by a plurality of shear pins 74. The combined shear rating of the pins 74 is selected to yield to a predetermined overload tension level developed in the work string 24, to permit the snap ring 70 to be released and retracted when it is desired to retract the service tool 12 to a new operating position or to retrieve the work string and service seal unit from the well.

As can best be seen in FIG. 1, the mandrel box 62 joins the lower end of the service seal unit with the snap ring 70 being positioned in obstructing engagement against the beveled annular face 76 of the ported flow sub 54. The fixed axial spacing of the snap ring 70 in its blocked position relative to the flow ports of the service seal unit 12 is pre-established to provide communication between flow ports and passages of the service seal unit with certain flow ports and passages in the packer 16 when the positive indication snap ring 70 is drawn into obstructing engagement with the beveled face 76 of the ported flow sub.

The engaged position of the positive indication snap ring 70, as shown in FIG. 1, corresponds with an upper circulating gravel pack operation. That is, obstructing engagement of the snap ring 70 against the ported flow sub 54 provides a positive indication that a predetermined positioning of downhole components has been achieved, and a downhole gravel pack service operation can be initiated. Additionally, because the snap ring 70 is blocked in the obstructing position by the high strength shear pins and shear sleeve 72, the service operations can be carried out over a wide range of work string tension levels without disturbing the desired position of the service tool, and without causing premature overload and inadvertent shear release. Moreover, because of the obstructing engagement, substantially all work string slack can be taken up as tension is developed in the work string. This stabilizes the location of the service tool and reduces manipulation of the work string at the surface.

Figure 3:
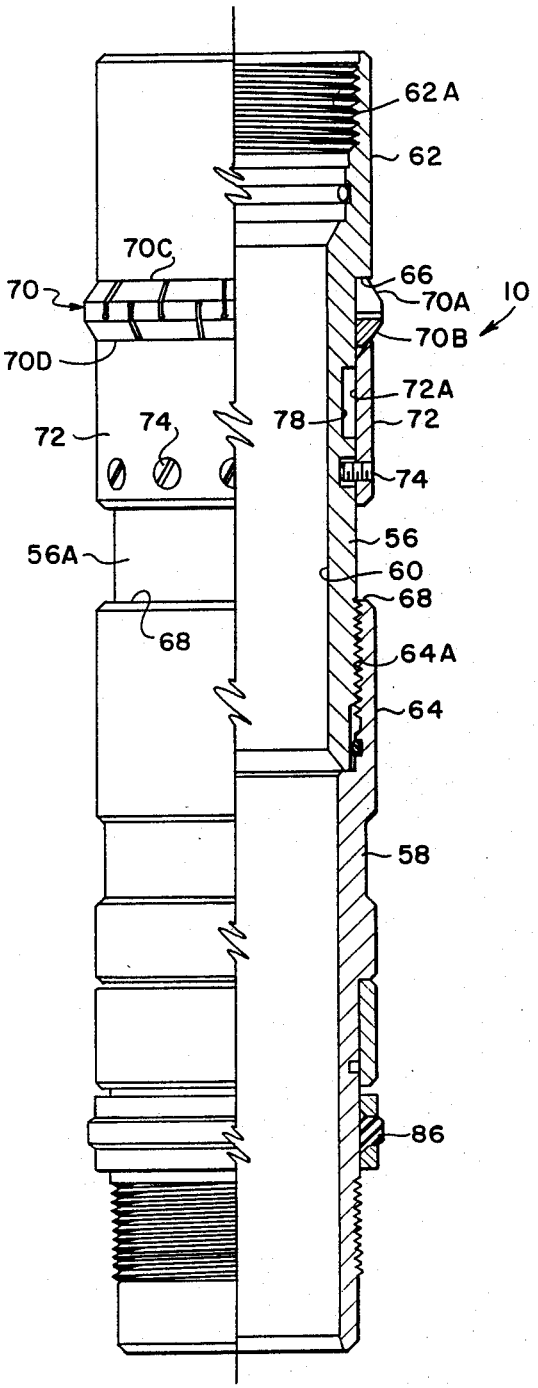
FIG. 3 is a view, partially in section and elevation, showing the snap ring and mandrel assembly with the shear sleeve supporting the snap ring in its obstructing position.

An external, annular recess 78 is formed in the sidewall of the mandrel between the shear pins 74 and the snap ring 70. The snap ring 70 has a radially projecting annular shoulder 70A which is engaged on its underside by a beveled face 80 of the shear sleeve 72. As the tension loading on the work string 24 increases above the combined shear strength of the pins 74 the pins are sheared. The shear sleeve 72 and positive indication snap ring 70 are displaced downwardly along the mandrel 56. In FIG. 3, the shear pins 74 are intact and in FIG. 4, upon shearing, the shear pins 74 are separated into two fragments 74A and 74B. As the snap ring 70 moves into the annular recess 78, it contracts radially within the recess 78 to permit the snap ring 70 to pass through the polished bore 54A of the ported flow sub 54. The shear pin fragments 74A are retained by the shear sleeve 72, and the shear pin fragments 74B are retained by threaded engagement.

Figure 4:
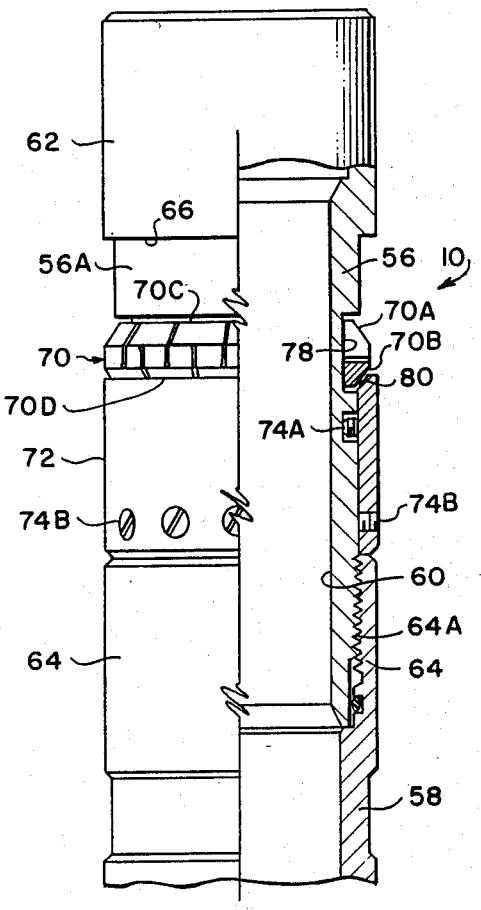
FIG. 4 a view similar to FIG. 3 in which the shear pins have been overloaded and the support sleeve and snap ring have been displaced along the mandrel, with the snap ring being radially retracted in a non-obstructing position within an annular recess.

The radially retracted, relaxed position of the snap ring 70 within the recess 78 is illustrated in FIG. 4. It will be seen that the snap ring 70 has been retracted out of engagement with the mandrel box shoulder 66, and the shear sleeve 70 has been displaced along the mandrel into engagement with the annular face 68 of the adaptor sub 58. Upon displacement and radial retraction of the snap ring 70 within the recess 78, the service tool 12 and work string 24 can be further retracted to establish a new service tool operating position, for example as shown in FIG. 2, in which the service seal tool 12 is retracted out of engagement with the packer bore 14. In the position shown in FIG. 2, the annulus 82 between the tubing 48 and the wash pipe 46 is sealed with respect to the bore 14 of the packer and the annulus 84 between the well casing 22 and the work string 24 by a seal 86 carried on the adaptor sub 58, which engages the polished bore 54A of the ported flow sub 54.

Referring now to FIGS. 5, 6, 7 and 8, the snap ring 70 is in the form of an annular body 88 having a cylindrical internal bore 90. The annular shoulder portion 70A projects radially from the annular body 88. The annular body 88 has first and second end portions 92, 94 which are circumferentially displaceable with respect to each other to permit the snap ring 70 to be expanded and fitted about the mandrel 56.

According to an important feature of the preferred embodiment, the body 88 of the snap ring 70 is intersected by a plurality of slots which are angularly displaced with respect to each other. The purpose of the slots is to permit the snap ring 70 to expand and recover without permanent deformation. In the preferred embodiment, a plurality of angularly spaced slots 96 are formed in the top half of the ring body 88, and a plurality of slots 98 intersect the lower half of the ring body 88. The slots 96 intersect the ring body 88 substantially in parallel with the longitudinal axis A of the ring body 88. Preferably, the slots 98 formed in the lower half of ring body 88 are circumferentially offset with respect to and alternate with the slots 96 formed in the upper half of the ring body 88.

Figure 9:
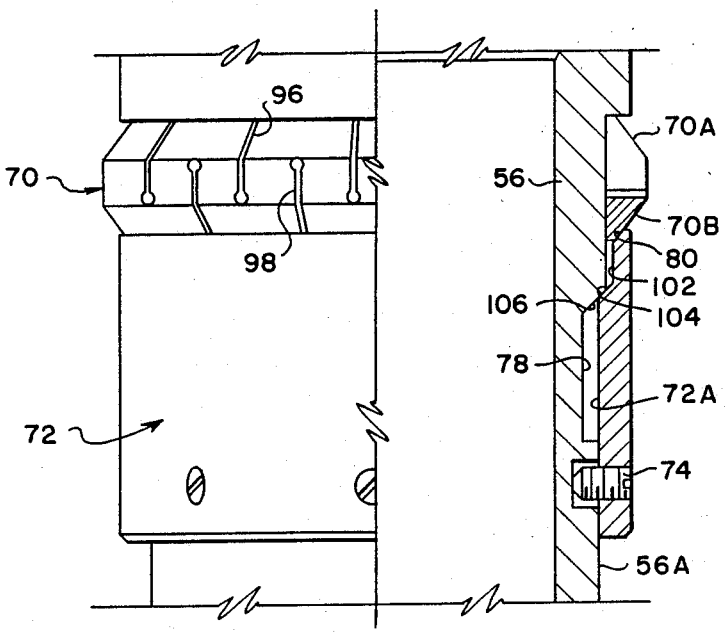
FIG. 9 is a view, partially in section and elevation, which illustrates a first alternative embodiment of the shear support sleeve; and, FIG. 10 is a view similar to FIG. 9 which illustrates a second alternative embodiment of the shear support sleeve.
Figure 10:
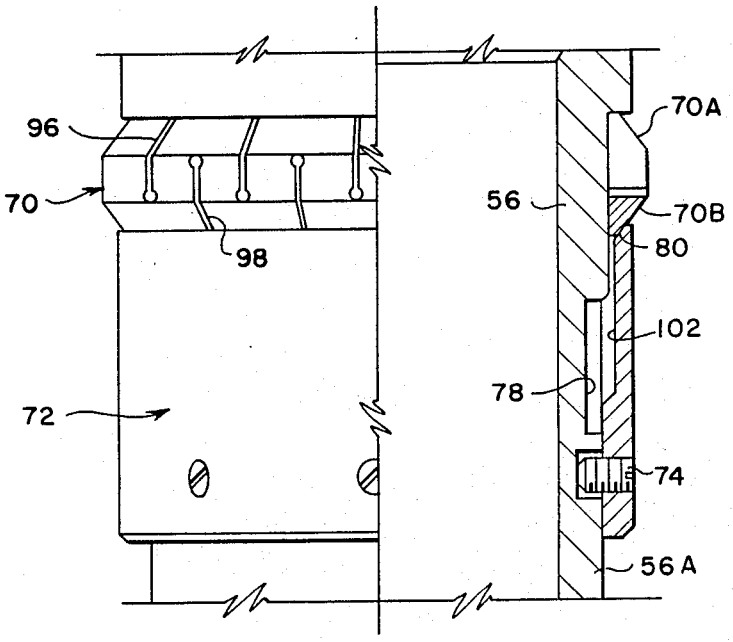

The lower slots 98 alternate with the upper slots 96 around the periphery of the ring body 88. The upper slots 96 intersect the upper annular face 70B and extend substantially halfway through the ring body 88. Likewise, the lower slots 98 intersect the lower annular face 70C and extend substantially halfway through the ring body 88. Greater flexibility is achieved by extending the slots slightly more than halfway through the ring body 88 as shown in FIGS. 9 and 10.

Figure 6:
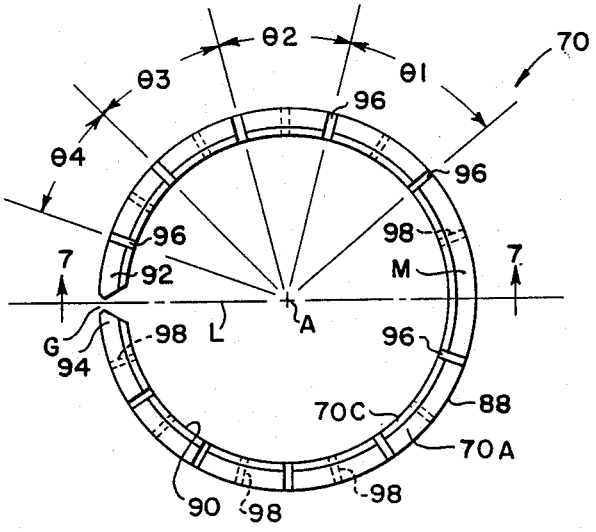
FIG. 6 is a top plan view of the snap ring shown in FIG. 5.

According to an important feature of the preferred embodiment, the alternating slots 96, 98 are angularly displaced with respect to the centerline L of the snap ring from a large angle at the back of the ring to progressively smaller angles toward the front of the ring. For the purposes of this description, the centerline L of the ring 70 is defined as the line L which intersects the axis A and which extends midway through the gap G between the ring end portions 92, 94, as shown in FIG. 6.

Figure 7:
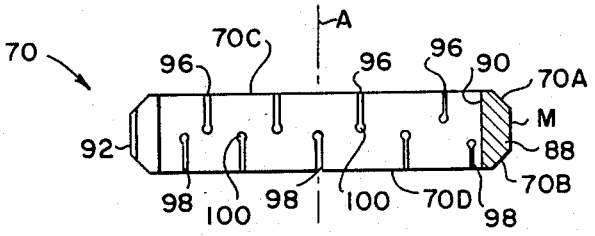
FIG. 7 is a sectional view of the positive indication snap ring taken along the line 7—7 in FIG. 6.
Figure 8:
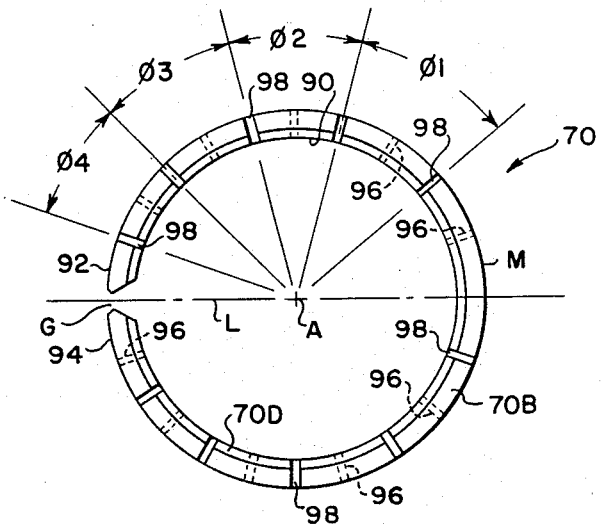
FIG. 8 is a bottom plan view of the positive snap ring shown in FIG. 6.

It will be seen that the angular displacement $\theta$ of slots 96 decreases around the periphery of the ring 70 as measured from its back region M toward the open gap G between the end portions 92, 94. As can be seen in FIG. 6, using the slot 96 which adjoins the back region M as a reference, the displacement angle $\theta 1$ is greater than the displacement angle $\theta 2$, $\theta 2$ is greater than $\theta 3$ and $\theta 3$ is greater than $\theta 4$. Likewise, the angular spacings between the slots 98 formed in the lower half of the ring body 88 are spaced at progressively smaller angles $\phi 1$, $\phi 2$, $\phi 3$ and $\phi 4$, respectively. Stress is relieved around the terminal end of each slot within the ring body 88 by enlarging the slot with a small bore 100 as shown in FIG. 7.

Preferably, the depth of the slots 96, 98 formed in the back region M of the ring body 88 is less than the depth of the slots formed near the ring end portions 92, 94. As can best be seen in FIG. 7, the lower and upper slots adjoining the back ring body region M are not as deep as the remaining slots, with the shallow slots being formed in the back region M of the snap ring which is subjected to the highest stress forces, and with the deeper slots being formed in the front portions of the ring which are subjected to relatively lower stress forces.

According to the foregoing arrangement, the slots 96, 98 are more widely separated and are shallower in the high stress regions of the snap ring 70, and are more closely located and are deeper in the lower stress region of the snap ring. As a result, the stress forces which arise within the ring body 88 as the ring is expanded to fit about the external mandrel surface 56A are more uniformly distributed through the ring body 88. This permits the thickness of the ring body 88 to be increased while maintaining adequate flexibility and resiliency. With increased ring thickness, the surface areas of contact provided by the radially projecting shoulders 70A, 70B are increased and the snap ring can transmit correspondingly higher stress forces to the shear sleeve. Thus, a larger number of shear pins can be used, and the overall shear rating provided by the pins can be increased for the relatively thick ring body configuration of the preferred embodiment.

Referring again to FIGS. 3 and 4, the beveled cam surface 80 of the shear sleeve 72 is adapted to ride onto the radially projecting, beveled shoulder 72B of the snap ring 70. The purpose of the cam engagement between the complementary beveled surfaces of the shear sleeve and the snap ring is to assist the spring forces within the snap ring 70 to retract the snap ring radially within the annular recess 78. That is, the cam surface 80 of the shear sleeve 72 overlaps and rides up over the beveled face 70B as the pins 74 are sheared. A reaction force is directed radially inwardly onto the lower face 70B of the snap ring 70 as the snap ring 70 and shear sleeve 72 are displaced along the external mandrel surface 56A. The assistance provided by the cam surface 80 is useful to overcome adverse downhole conditions in which sand might accumulate within the annular recess 78. The additional cam force assists the snap ring 70 in displacing such sand out of the annular recess 78 as the snap ring 70 enters the recess.

Referring now to FIGS. 9 and 10, first and second alternative embodiments of the shear sleeve 72 are illustrated. In FIG. 9, the shear sleeve 72 has a counterbore 102 which enlarges its central bore 72A. The counterbore 102 transitions transversely along a cam surface 104 to the primary cylindrical bore 72A. In this configuration, the annular recess 78 is bounded on its upper side by a beveled face 106 which is engaged with the annular cam surface 104. The purpose of this arrangement is to react forces which might inadvertently be applied to the shear sleeve 72 during run-in. This permits the assembly to be pushed through restricted or crooked bores without prestressing, cold working or inadvertently shearing the pins 74 during the run-in operation.

In the second alternative embodiment of the shear sleeve 72 as shown in FIG. 10, the counterbore 102 is relatively deep as compared with the first alternative embodiment shown in FIG. 9. In this embodiment, the surface area of engagement provided by the cam surface 80 is reduced somewhat compared with the surface area of engagement shown in the FIG. 4 embodiment. Because the shear sleeve wall is substantially thinner along its length, it develops a greater cam force which is applied to the snap ring 70 through the shoulder surface 70B to assist the snap ring in retracting radially into the annular recess 78.

The foregoing snap ring and shear sleeve combinations provide a positive stop to motion of the work string to permit a service operation to be performed. Upon application of sufficient tension in the work string, the shear pins are sheared, thereby allowing the snap ring to retract out of obstructing engagement to permit the service tool to be retracted to a new operating position or retrieved from the well.

Although the invention has been described with reference to specific embodiments, and with reference to a specific gravel pack application, the foregoing description is not intended to be construed in a limiting sense. Various modifications of the disclosed embodiments as well as alternative applications of the invention will be suggested to persons skilled in the art by the foregoing specification and illustrations. It is therefore contemplated that the appended claims will cover any such modifications, applications or embodiments as fall within the true scope of the invention.

What is claimed is:

1. A snap ring comprising an annular body having an internal bore and a radially projecting, annular shoulder; said annular body having first and second end portions which are circumferentially displaceable with respect to each other; the body of said ring being intersected by a plurality of slots which are disposed at circumferentially spaced locations on the periphery of said body; and, the annular body of said snap ring having a back region diametrically opposite to said first and second end portions, said slots being angularly displaced with respect to each other by a relatively large angle toward the back region of said ring body and being angularly displaced by progressively smaller angles toward the end portions of said ring body.

2. A snap ring as defined in claim 1, including one or more slots intersecting the body of said ring on opposite sides of said back region, and including one or more slots intersecting said ring body toward said snap ring end portions, wherein the depth of slots near the back region of the snap ring being less than the depth of slots formed toward the end portions of the snap ring.

3. A snap ring as defined in claim 1, including a first plurality of slots intersecting said ring body through an upper half portion thereof, and including a second plurality of slots intersecting said ring body through the lower half thereof, wherein the slots formed in the lower half of the ring body are circumferentially offset with respect to and alternate with the slots formed in the upper half of the ring body.

4. A snap ring as defined in claim 1, wherein at least one of said slots is enlarged and terminated within said ring body by a cylindrical bore which extends transversely through said ring body, said cylindrical bore having a diameter which exceeds the width of said slot.

5. A snap ring as defined in claim 1, said radially projecting annular shoulder having a first annular, beveled face and a second annular, beveled face, said first and second beveled faces being axially spaced with respect to each other.

6. Well production apparatus comprising, in combination:

a packer adapted for releasable engagement with the bore of a well casing, said packer having a mandrel and a longitudinally extending bore formed in said mandrel;

a ported flow sub mounted on said packer mandrel, said ported flow sub having a bore in flow communication with said packer bore and an internal annular shoulder concentric with its bore;

a service tool adapted for extension and retraction in sealing engagement with the bore of said packer; and, a positive indication shear ring assembly connected to said service tool and disposed within the bore of said flow sub, said positive indication shear ring assembly including a mandrel having a tubular sidewall and an annular recess formed on the external surface of said mandrel tubular sidewall, a resilient snap ring mounted for movement from a first position on said mandrel in which said snap ring is expanded and is axially displaced and removed from said recess to a second position in which said snap ring is contracted and received within said recess, said resilient snap ring being adapted for engagement against the internal annular shoulder of said ported flow sub in said first mandrel position, a tubular shear sleeve being mounted on said mandrel for movement from a first position on said mandrel in which said sleeve is overlying and covering said annular recess, to a second position on said mandrel in which said annular recess is uncovered, and a plurality of shear pins connecting said shear sleeve to the sidewall of said mandrel on the opposite side of said annular recess, with said shear sleeve being releasably retained in said first mandrel position by said pins.

7. A positive indication shear ring assembly comprising, in combination:

a mandrel having a tubular sidewall and an external annular recess formed in said tubular sidewall;

a resilient snap ring mounted on said mandrel on one side of said annular recess;

a tubular shear sleeve mounted on said mandrel for movement from a first position on said mandrel with said sleeve overlying said annular recess, to a second position on said mandrel in which said annular recess is uncovered;

a plurality of shear pins connecting said shear sleeve to the sidewall of said mandrel on the opposite side of said annular recess, with said shear sleeve being disposed and retained in said first mandrel position by said pins; and, said shear sleeve having a counterbore and an annular cam surface extending transversely between said counterbore and said internal bore, and said mandrel having a complementary cam surface forming a transverse shoulder adjoining said annular recess, said annular cam surface of said shear sleeve being disposed for engagement with the complementary annular surface of said mandrel.

8. A positive indication shear ring assembly comprising, in combination:

mandrel having a tubular sidewall and an external annular recess formed in said tubular sidewall;

a resilient snap ring mounted on said mandrel for movement from a first position in which said snap ring is removed and axially displaced from said recess to a second position in which said snap ring is contracted and received within said recess;

a tubular shear sleeve mounted on said mandrel for movement from a first position on said mandrel in which said sleeve is overlying and covering said annular recess, to a second position on said mandrel in which said annular recess is uncovered;

a plurality of shear pins connecting said shear sleeve to the sidewall of said mandrel on the opposite side of said annular recess, with said shear sleeve being disposed and retained in said first mandrel position by said pins; and, said snap ring including an annular body having an internal bore and a radially projecting, annular shoulder, first and second end portions which are circumferentially displaceable with respect to each other, said annular body having first and second axially spaced sections, including a first plurality of slots intersecting said first body section and including a second plurality of slots intersecting said second body section, wherein the slots formed in one body section are circumferentially offset with respect to and alternate with the slots formed in the other body section.

9. A positive indication shear ring assembly as defined in claim 8, the annular body of said snap ring having a back region diametrically opposite to said first and second end portions, with said slots being angularly displaced with respect to each other by a relatively large angle toward the back of the ring and by progressively smaller angles toward the end portions of the ring.

10. A positive indication shear ring assembly as defined in claim 8, including one or more slots intersecting the body of said ring on opposite sides of said back region, and including one or more slots intersecting said ring body toward said snap ring end portions, wherein the depth of slots near the back region of the snap ring is less than the depth of slots formed toward the end portions of the snap ring.

11. A positive indication shear ring assembly as defined in claim 8, wherein said slots extend axially more than halfway through said annular body.

12. A positive indication shear ring assembly as defined in claim 8, wherein at least one of said slots is enlarged and terminated within said ring body by a cylindrical bore which extends transversely through said ring body, said cylindrical bore having a diameter which exceeds the width of said slot.

13. A positive indication shear ring assembly as defined in claim 8, said shear sleeve having a counterbore and an annular cam surface extending transversely between said counterbore and said internal bore, and said mandrel having a complementary cam surface forming a transverse shoulder adjoining said annular recess, said annular cam surface of said shear sleeve being disposed for engagement with the complementary annular surface of said mandrel.

14. A positive indication shear ring assembly as defined in claim 8, said shear sleeve having a counterbore extending axially for at least half of the length of said shear sleeve.

15. A positive indication shear ring assembly as defined in claim 8, including a tubular adaptor sub coupled to said mandrel, said adaptor sub having a radial shoulder defining a mechanical stop for limiting displacement of said shear sleeve along said mandrel.

* * * * *